US005752483A

United States Patent [19]

Greaney et al.

[11] Patent Number: 5,752,483

[45] Date of Patent: May 19, 1998

[54] GOVERNOR ARRANGEMENT

[75] Inventors: Adrian Mark Greaney; Daniel Jeremy Hopley, both of Gillingham; Jack Paine, Chatham, all of Great Britain

[73] Assignee: Lucas Industries, plc, England

[21] Appl. No.: 706,310

[22] Filed: Aug. 30, 1996

[30] Foreign Application Priority Data

Sep. 1, 1995 [GB] United Kingdom ..... 9517815

[51] Int. Cl.[6] ..... F02D 31/00

[52] U.S. Cl. ..... 123/373; 74/573 R; 74/603; 384/121; 384/123; 137/47; 137/55; 137/57

[58] Field of Search ..... 384/121, 123; 123/373, 495; 137/47, 53, 55, 57; 74/573 R

[56] References Cited

U.S. PATENT DOCUMENTS

| | | | |
|---|---|---|---|
| 2,624,327 | 1/1953 | Hogeman | 123/373 |
| 3,199,499 | 8/1965 | Kleeberger . | |
| 3,830,211 | 8/1974 | Bechstein | 123/373 |
| 3,884,205 | 5/1975 | Staudt | 123/373 |
| 3,980,066 | 9/1976 | Hollins | 123/373 |
| 4,359,985 | 11/1982 | Mueller | 123/373 |
| 5,427,456 | 6/1995 | Hensel | 384/123 |
| 5,492,341 | 2/1996 | Pecht | 384/123 |

*Primary Examiner*—Denise L. Ferensic
*Assistant Examiner*—Ramyar Farid
*Attorney, Agent, or Firm*—Andrus, Sceales, Starke & Sawall

[57] ABSTRACT

A governor arrangement for an internal combustion engine is disclosed which comprises a plurality of weights rotatable with a rotatable drive shaft and pivotable with respect to the shaft. The weights are engageable with a washer which, in turn, engages a sleeve. The sleeve engages a lever the position of which is used to control the setting of a metering valve. A hydrodynamic bearing arrangement is provided between the sleeve and washer. A drive arrangement may be provided to drive the washer when the rotational speed of the shaft is insufficient to cause the weights to move the sleeve.

7 Claims, 2 Drawing Sheets

GOVERNOR ARRANGEMENT

This invention relates to a governor arrangement for an internal combustion engine.

In a diesel internal combustion engine, it is usual to provide a metering valve in order to control the quantity of fuel to be delivered to the injectors of the engine, such a metering valve being operable under the influence of a governor arrangement.

FIG. 1 illustrates a governor arrangement in which weights 1 are pivotally mounted with respect to a shaft 2 which is arranged to be rotated at a speed associated with engine speed. The weights 1 are arranged to cooperate with a thrust sleeve 3 such that upon rotation of the shaft 2, the weights 1 tend to move outwardly pushing the thrust sleeve 3 in an axial direction with respect to the shaft 2, a washer 9 being provided between the weights 1 and the thrust sleeve 3.

The thrust sleeve 3 engages a lever 4 which is biased by means of a governor spring 5 to oppose the movement of the thrust sleeve 3 by the weights 1. The lever 4 is coupled to a metering valve 6 through a suitable coupling arrangement 7 such that movement of the lever 4 results in opening or closing movement of the metering valve 6.

In use, for a particular engine speed the weights 1 will adopt a predetermined position resulting in the thrust sleeve 3, lever 4 and hence metering valve 6 occupying predetermined positions. If the engine speed changes, the positions of the weights 1 will also change thus effecting a change in the setting of the metering valve 6. The washer 9 is provided between the weights 1 and the thrust sleeve 3 in order to minimise wear therebetween, the washer 9 being free to rotate with respect to both the weights 1 and the thrust sleeve 3. It has been found that the washer 9 tends to remain stationary rather than rotating with the weights 1, resulting in most of the wear occurring between the weights 1 and the washer 9, the wear of the weights 1 causing the characteristics of the governor arrangement to change. It will be recognised that when the washer 9 does not rotate, the rotation of the weights 1 is such that the frictional forces between the washer 9 and the weights 1 are relatively small, thus relatively small changes in the speed of the shaft 2 cause a change in the radial positions of the weights 1.

It has further been found that occasionally the washer 9 slips and starts to rotate with the weights 1. When such movement of the washer 9 occurs, the reduction in the relative speed of the washer 9 with respect to the weights 1 results in an increase in the frictional forces therebetween. Radial movement of the weights 1 tends to be sudden when the frictional forces are overcome rather than smooth as in the case where the washer does not rotate with the weights 1. Such jerky movement of the weights 1 is transmitted to the metering valve 6 through the thrust sleeve 3, lever 4 and coupling arrangement 7.

According to the present invention there is provided a governor arrangement comprising a plurality of weights pivotable with respect to and rotatable with a rotatable shaft, the weights being arranged to engage a washer which is interposed between the weights and a thrust sleeve such that pivotal movement of the weights results in axial movement of the washer and the thrust sleeve, and bearing means to promote rotary motion between the washer and the thrust sleeve. The provision of such bearing means reduces the risk of the washer tending to remain stationary, but occasionally rotating with the weights.

Preferably, the governor arrangement further comprises a drive arrangement to promote rotational movement of the washer with respect to the thrust sleeve on commencement of rotation of the shaft. Such a drive arrangement further reduces the risk of the washer remaining stationary.

The drive arrangement conveniently comprises an annular member arranged to rotate with the drive shaft, the washer being arranged to engage the annular member when the drive shaft is stationary and when the drive shaft rotates at a speed less than the lowest speed at which movement of the weights causes axial movement of the thrust sleeve. The annular member conveniently comprises a rubber ring or a ring of material having rubber-like qualities. Alternatively, the annular member may include one or more teeth arranged to engage in corresponding recesses in the washer when the washer is to be driven by the annular member.

Conveniently the bearing means comprises a hydrodynamic bearing arrangement.

The invention will further be described, by way of example, with reference to the accompanying drawings, in which like reference numerals denote like parts, and in which.

Figure 1:
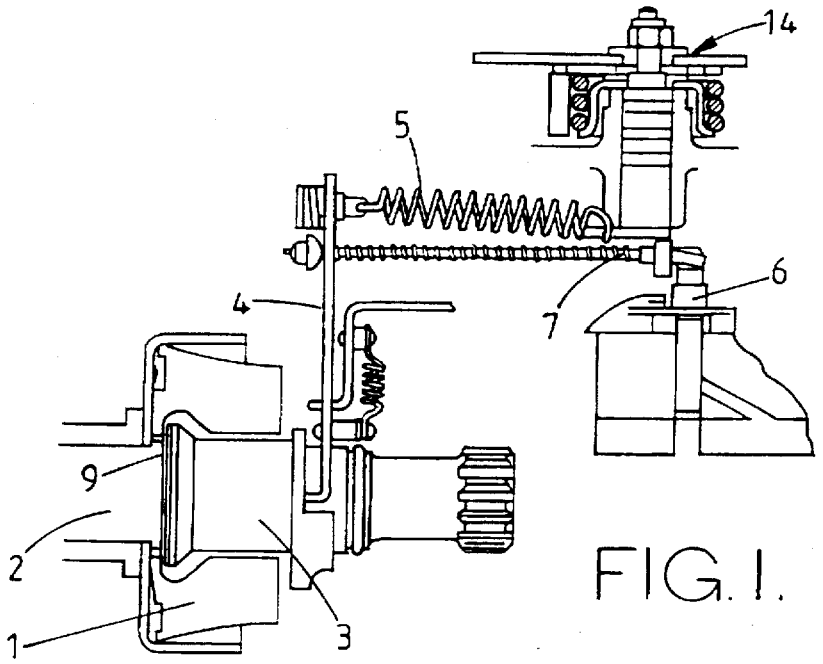
FIG. 1 is a diagrammatic illustration of a governor arrangement.
Figure 2:
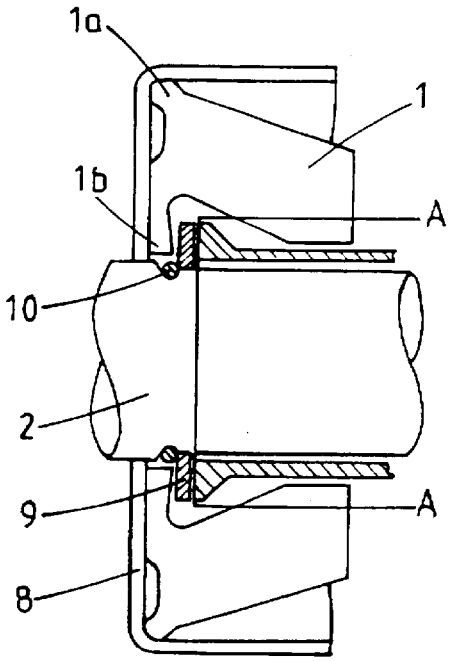
FIG. 2 is a diagrammatic view of part of a governor arrangement constituting an embodiment of the invention.
Figure 3:
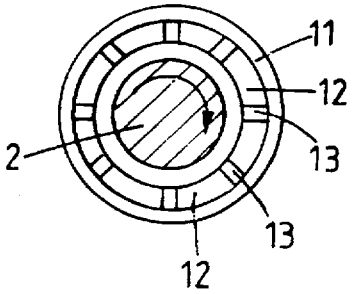
FIG. 3 is a cross-sectional view along the line A—A of FIG. 2.
Figure 4:
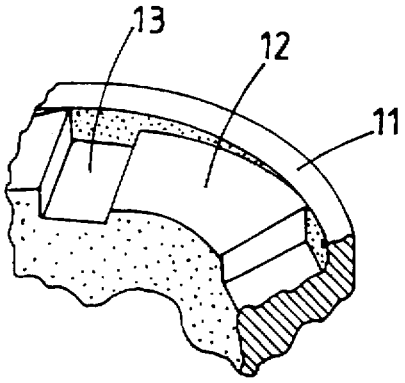
FIG. 4 is a perspective view of part of the thrust sleeve of the embodiment illustrated in FIGS. 2 and 3.

The parts of a governor arrangement illustrated in FIGS. 2 to 4 are intended for use in a governor arrangement of the type illustrated in FIG. 1. As illustrated in FIG. 2, the governor arrangement comprises a drive shaft 2 arranged to rotate at a speed associated with engine speed, a cage 8 being keyed to the drive shaft 2 so as to rotate therewith, the cage 8 being axially fixed with respect to the drive shaft 2. A plurality of weights 1 are mounted within the cage 8, each weight 1 having a region la arranged to engage the cage 8 to permit the weights 1 to pivot with respect to the cage 8. The weights 1 are so arranged that they rotate with the cage 8. Each weight 1 further comprises a toe **1*b* which is engageable with a face of a thrust washer 9 which encircles the drive shaft 2**.

The governor arrangement further comprises a thrust sleeve 3 which is moveable in the axial direction of the drive shaft 2, the thrust sleeve 3 encircling the drive shaft 2. As in the arrangement illustrated in FIG. 1, the thrust sleeve 3 is arranged to engage a lever 4 which is biassed by means of a governor spring 5 in order to push the thrust sleeve 3 towards the left as illustrated in FIG. 2. The engagement of the thrust sleeve 3 with the lever 4 further limits rotational movement of the thrust sleeve 3. As illustrated in FIG. 2, the thrust washer 9 is interposed between the toes **1*b* of the weights 1 and a free end region of the thrust sleeve 3**.

The drive shaft 2 is provided with an annular groove within which a rubber ring 10 is seated. The groove is positioned such that when the drive shaft 2 is stationary and the weights 1 occupy their inner most position due to the thrust sleeve 3 being urged towards its left most position by means of the spring 5, the thrust washer 9 is trapped between the ring 10 and the free end of the thrust sleeve 3. Upon rotation of the drive shaft 2, the washer 9 is caused to rotate with the drive shaft 2 due to the engagement between the washer 9 and the ring 10. As the speed of rotation of the drive shaft 2 is increased, a speed will be reached beyond which the weights 1 tend to pivot outwardly, the regions **1*a* thereof remaining in contact with the cage 8, such pivotal movement of the weights 1 bringing the toes 1*b* into contact with the washer 9, the engagement between the weights 1 and the washer 9 acting against the force pushing the washer 9 into engagement with the ring 10. It will be recognised that further movement of the weights 1 results in axial movement of the washer 9 to break the engagement between the washer 9 and the ring 10**.

FIG. 3 is a view of the end of the thrust sleeve 3, FIG. 4 being a perspective view of part of the end of the thrust sleeve 3. As illustrated in FIGS. 3 and 4, the end of the thrust sleeve includes an annular raised surface 11, and radially inward of the surface 11, a plurality of ramped surfaces 12 are provided, each of the ramped surfaces 12 being spaced from the remaining surfaces 12 by respective grooves 13. In use, the governor arrangement is provided within a housing containing relatively low pressure fuel. Upon rotation of the drive shaft 2, fuel which is located between the drive shaft 2 and the thrust sleeve 3 tends to move radially outward into the grooves 13 and on to the ramped surfaces 12. The rotation of the washer 9 with respect to the end of the thrust sleeve 3 tends to draw fuel from the grooves 13 up the ramped surfaces 12, and as the separation of the washer 9 from the ramped surfaces 12 is not uniform, decreasing in the direction of rotation of the washer 9 the pressure of the fuel increases. Such a pressure increase results in the washer 9 tending to be held away from the end of the thrust sleeve 3 by the fuel, thus forming a hydrodynamic bearing. At normal operating speed, such hydrodynamic lubrication between the washer 9 and the end of the thrust sleeve 3 tends to maintain rotation of the washer 9 with respect to the thrust sleeve 3.

It will be recognised that although the lubrication between the washer 9 and the thrust sleeve 3 is improved, friction is still present, and hence there are forces tending to reduce the speed of the washer 9, those forces being lower than the frictional forces between the toes of the weights 1 and the washer 9. Such frictional forces result in the washer 9 rotating at a speed slightly slower than the speed of rotation of the weights 1. The small amount of relative rotation between the washer 9 and the weights is advantageous in that wear occurring on the washer 9 is evenly distributed around the washer 9 rather than being restricted to relatively small areas. It has been found that there is a relative speed of approximately 1 revolution per minute.

The provision of the raised surface 11 surrounding the ramped surfaces 12 and grooves 13 protects the ramped surfaces 12 from wear, and additionally limits radial leakage of fuel from the grooves 13 and ramped surfaces 12 thus improving the efficiency of the hydrodynamic lubrication. It will, however, be understood that the raised surface 11 is not essential.

In use of the governor arrangement, variations in engine speed resulting in variations in the speed of rotation of the drive shaft 2 cause the weights 1 to adopt different pivotal positions with respect to the drive shaft 2, hence causing the thrust sleeve 3 to adopt a different axial position. Such movement of the thrust sleeve 3 is transmitted to the metering valve 6 through the lever 4 and suitable coupling arrangement 7, for example as in the arrangement illustrated in FIG. 1. It will be understood that the operation of the governor arrangement is dependent upon the level of stressing of the governor spring 5, and as shown in the conventional arrangement illustrated in FIG. 1, a manually operable lever 14 may be provided in order to control the level of stressing of the governor spring 5.

We claim:

1. A governor arrangement comprising a plurality of weights pivotable with respect to and rotatable with a rotatable shaft, the weights being arranged to engage a washer which is interposed between the weights and a thrust sleeve such that pivotal movement of the weights results in axial movement of the washer and the thrust sleeve, bearing means to promote rotary motion between the washer and the thrust sleeve, and a drive arrangement to promote rotational movement of the washer with the shaft upon commencement of rotation of the shaft, the drive arrangement ceasing to act to promote rotational movement of the washer upon the speed of rotation of the shaft exceeding a predetermined speed, the drive arrangement comprising a surface associated with and arranged to rotate with the shaft, the washer being biased, in a direction substantially parallel to the axis of rotation of the shaft, into engagement with the surface when the shaft is stationary and when the shaft rotates at a speed which is less than the lowest speed at which movement of the weights causes axial movement of the thrust sleeve, said surface comprising abutment means extending radially from the shaft to prevent engagement between the washer and the weights at speeds below said lowest shaft speed, the washer being lifted from engagement with said surface by the weights when the speed of rotation of the shaft exceeds the predetermined speed to disengage the drive arrangement.

2. A governor arrangement as claimed in claim 1, wherein the bearing means comprises a hydrodynamic bearing arrangement.

3. A governor arrangement as claimed in claim 2, wherein the hydrodynamic bearing arrangement comprises a plurality of ramped surfaces provided on the end of the thrust sleeve facing the washer.

4. A governor arrangement as claimed in claim 3, wherein the ramped surfaces are spaced apart by radially extending grooves.

5. A governor arrangement as claimed in claim 3, further comprising an annular wall surrounding the ramped surfaces.

6. A governor arrangement as claimed in claim 1, wherein the surface is defined by an annular member.

7. A governor arrangement as claimed in claim 6, wherein the annular member comprises a rubber material ring.

* * * * *